US009377730B1

(12) United States Patent
Furuyama

(10) Patent No.: US 9,377,730 B1
(45) Date of Patent: Jun. 28, 2016

(54) IMAGE FORMING APPARATUS AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Noboru Furuyama, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/576,538

(22) Filed: Dec. 19, 2014

(51) Int. Cl.
*G03G 15/20* (2006.01)

(52) U.S. Cl.
CPC ..... *G03G 15/205* (2013.01)

(58) Field of Classification Search
CPC ..... G03G 15/205; G03G 15/2078; G03G 15/2039
See application file for complete search history.

(56) References Cited

U.S. PATENT DOCUMENTS

| | | | | |
|---|---|---|---|---|
| 6,094,546 | A * | 7/2000 | Nakazato et al. | 399/1 |
| 8,934,801 | B2 * | 1/2015 | Saito | 399/70 |
| 2014/0079425 | A1 * | 3/2014 | Tanaka | G03G 15/205 399/70 |

* cited by examiner

*Primary Examiner* — Gregory H Curran
(74) *Attorney, Agent, or Firm* — Amin, Turocy & Watson LLP

(57) ABSTRACT

An image forming apparatus includes a fixing member to fix toner to a recording medium, a heating control part to heat the fixing member to a specified temperature, a measuring part to measure a temperature of the fixing member, and a calculation part to calculate an arrival time required until the temperature of the fixing member reaches a target temperature based on a difference between the target temperature at a warming-up end time of the fixing member and the temperature measured by the measuring part. If the arrival time is shorter than a rise time required to warm up the image forming apparatus, the heating control part starts to heat the fixing member after a specified time passes from a time when warming-up of the image forming apparatus is started.

5 Claims, 8 Drawing Sheets

FIG. 7

TB

| DIFFERENCE Δt BETWEEN TARGET TEMPERATURE tr AND MEASURED TEMPERATURE t | SUPPLIED POWER (W) |
|---|---|
| Δ t>150 | 1100 |
| 150≧Δ t>110 | 900 |
| 110≧Δ t>90 | 700 |
| 90≧Δ t>70 | 500 |
| 70≧Δ t>30 | 200 |

IMAGE FORMING APPARATUS AND IMAGE FORMING METHOD

FIELD

Embodiments described herein relate generally to an image forming apparatus and an image forming method.

BACKGROUND

An image forming apparatus such as a copying machine or a composite machine includes a fixing device to fix a toner image on a sheet at the time of printing. In order to stably perform printing on the sheet, the heat capacity of the fixing device must be large to a certain degree. Thus, warming-up of the fixing device requires a certain time.

However, the time required to warm up the fixing device is shortened by recent technical development. Thus, according to the peripheral environment and use state of the fixing device, there is a case where the warming-up of the fixing device is ended before a control system and the like of the image forming apparatus start up. In this case, power for keeping the temperature of the fixing device is wastefully consumed until the control system starts up.

DESCRIPTION OF THE DRAWINGS

FIG. 7 is a table showing a relation between a difference between a target temperature of a fixing belt and a measured temperature and supplied power according to a second embodiment.

DETAILED DESCRIPTION

In general, according to one embodiment, an image forming apparatus includes a fixing member to fix toner to a recording medium, a heating control part to heat the fixing member to a specified temperature, a measuring part to measure a temperature of the fixing member, and a calculation part to calculate an arrival time required until the temperature of the fixing member reaches a target temperature based on a difference between the target temperature at a warming-up end time of the fixing member and the temperature measured by the measuring part. If the arrival time is shorter than a rise time required to warm up the image forming apparatus, the heating control part starts to heat the fixing member after a specified time passes from a time when warming-up of the image forming apparatus is started.

First Embodiment

Figure 1:
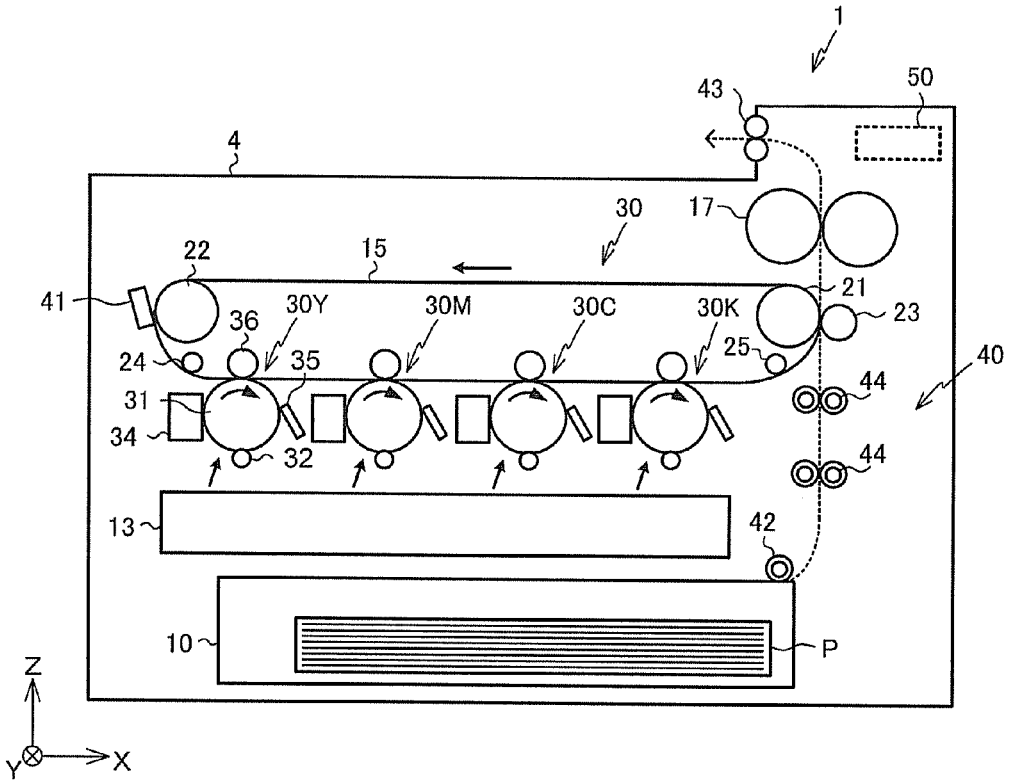
FIG. 1 is a view showing a structure of an image forming apparatus of a first embodiment.

Hereinafter, a first embodiment of the invention will be described with reference to the drawings. FIG. 1 is a view showing a structural example of an image forming apparatus 1 of the first embodiment. The image forming apparatus 1 is a color laser printer in which toners of yellow, magenta, cyan and black are used. The image forming apparatus 1 includes a housing 4, a fixing device 17 housed in the housing 4, an image forming unit 30, a laser exposure device 13, a paper feed cassette 10 and a control device 50.

The housing 4 is a rectangular parallelepiped casing made of resin, and a paper discharge part is formed on the upper surface thereof.

Figure 2:
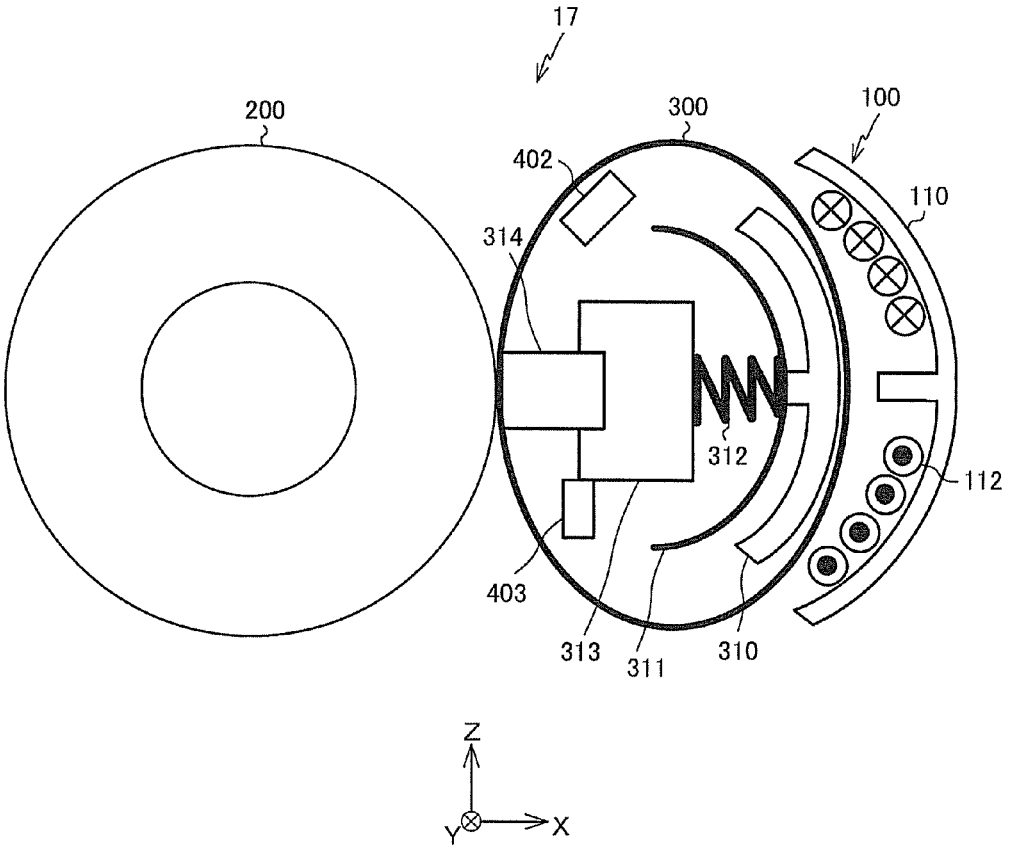
FIG. 2 is a view showing a structure of a fixing device.

FIG. 2 is a view showing a structure of the fixing device 17. The fixing device 17 includes a pressure roller 200, a fixing belt 300, a heating unit 100, a temperature sensor 402, a thermostat 403, a pressure pat 314, a holding member 313, an aluminum member 311 and a magnetic shunt member 310.

Figure 3:
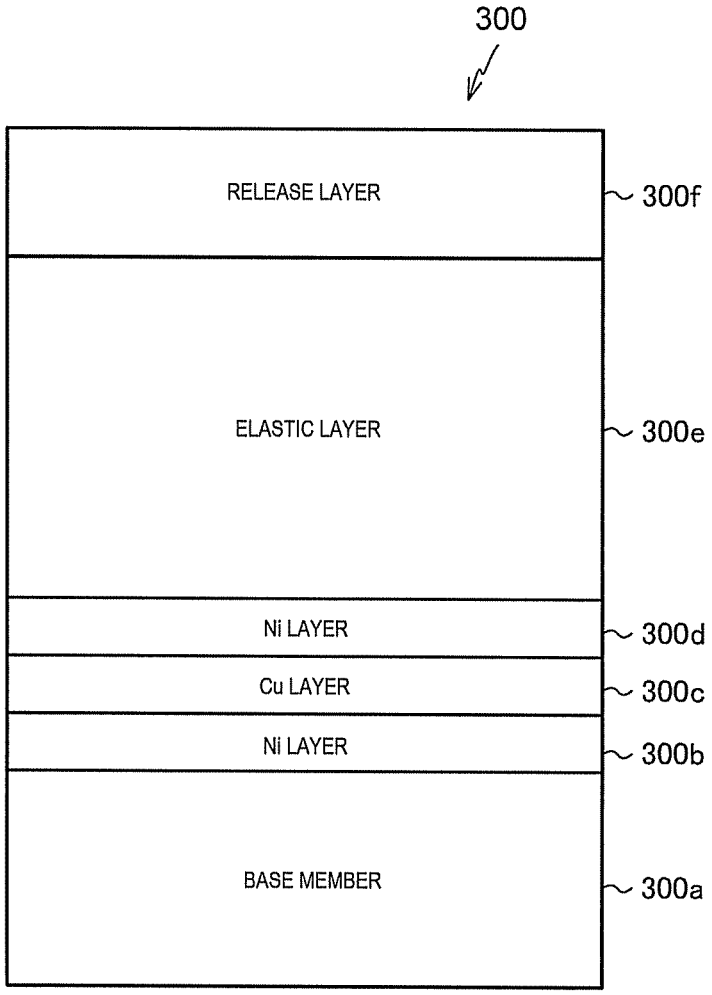
FIG. 3 is a view showing a section of a fixing belt.

The fixing belt 300 is an annular member whose longitudinal direction is an X-axis direction and is arranged in a state parallel to the pressure roller 200. FIG. 3 is a view showing a part of the section of the fixing belt. As shown in FIG. 3, the fixing belt 300 includes a base member 300*a*, Ni layers 300*b* and 300*d*, a Cu layer 300*c*, an elastic layer 300*e* and a release layer 300*f*.

The base member 300*a* has a thickness of about 70 μm and is a layer made of a polyimide sleeve. The Ni layer 300*b*, the Cu layer 300*c*, the Ni layer 300*d*, the elastic layer 300*e* and the release layer 300*f* are sequentially formed outside the base member 300*a*.

The Ni layer 300*b*, the Cu layer 300*c* and the Ni layer 300*d* are heat generation layers to generate heat by the electromagnetic operation of the heating unit 100. The Ni layer 300*b*, the Cu layer 300*c* and the Ni layer 300*d* are made of nickel or copper, and the thicknesses are respectively 1 μm, 10 μm and 8 μm. The elastic layer 300*e* is a layer made of silicon and having a thickness of about 200 μm. The release layer 300*f* is positioned at the outermost side of the fixing belt. The release layer 300*f* is made of fluorine resin such as PFA and has a thickness of about 30 pin.

As shown in FIG. 2, the fixing belt 300 is rotatably supported around the holding member 313.

The heating unit 100 is arranged near the fixing belt 300. The heating unit 100 includes a core 110 made of ferrite and a coil 112. When a high frequency current flows through the coil 112, a magnetic flux is generated. The magnetic flux crosses the fixing belt 300, so that the fixing belt 300 is heated. In the heating unit 100, the core 110 functions as a shield. Thus, the magnetic flux is generated only on the −X side of the coil 112.

The temperature sensor 402 and the thermostat 403 are arranged inside the fixing belt 300. The temperature sensor 402 measures the temperature of the fixing belt 300 and outputs a signal corresponding to the measurement result. The thermostat 403 includes a contact which is turned on when the temperature inside the fixing belt 300 becomes a threshold or higher. The thermostat 403 is used in order to avoid overheating of the fixing belt 300.

The holding member 313 is a member whose longitudinal direction is a Y-axis direction. The holding member 313 is fixed in a state of being inserted in the fixing belt 300. The pressure pat 314 is fixed to the −X side of the holding member 313, and an elastic member 312 is fixed to the +X side thereof.

The pressure pat 314 is a member whose longitudinal direction is the Y-axis direction. The pressure pat 314 is made of phenol resin having heat resistance and is held inside the fixing belt 300 by the holding member 313. A surface (contact surface) of the pressure pat 314 at the −X side is shaped into a curved form along the surface of the inside of the fixing belt 300. Besides, the contact surface of the pressure pat 314 contacts an area including a portion of the fixing belt 300 which contacts the pressure roller 200. A low friction sheet for reducing friction force may be attached to the contact surface of the pressure pat 314.

The elastic member 312 is, for example, a push spring, and the −X side end thereof is fixed to the holding member 313. The magnetic shunt member 310 is attached to the +X side end of the elastic member 312 through the aluminum member 311 curved along the fixing belt 300.

The magnetic shunt member 310 is a member having a size comparable to the coil 112. The magnetic shunt member 310 has such a property that magnetic permeability is reduced when a temperature becomes Curie temperature or higher. Thus, when the temperature of the fixing belt 300 rises to a certain degree, the magnetic flux crossing the fixing belt 300 is reduced. By this, temperature rise of the fixing belt 300 is suppressed.

The pressure roller 200 includes a metal core member whose longitudinal direction is the Y-axis direction, an elastic layer such as a rubber layer laminated on the outer peripheral surface of the core member, and a release layer. The pressure roller 200 is urged by the elastic member in a direction (+X direction) toward the fixing belt 300. By this, the pressure roller 200 is pressed to the pressure pat 314 through the fixing belt 300. Thus, the surface of the pressure roller 200 and the surface of the fixing belt 300 are in a close contact state.

In the fixing device 17 constructed as described above, when the pressure roller 200 is rotated by a not-shown rotating mechanism, the fixing belt 300 is driven. Besides, when a high frequency current is supplied to the coil 112 in this state, the fixing belt 300 is heated. The fixing belt 300 is heated to a specified target temperature. The target temperature varies according to the model and specifications of the image forming apparatus 1. For example, the target temperature is a temperature at which a toner image formed on a sheet can be fixed on the sheet.

Incidentally, when the fixing belt 300 is directly driven, a fixing belt 300 may be provided with a one-way clutch in order to prevent a speed difference from occurring between the fixing belt 300 and the pressure roller 200.

As shown in FIG. 1, the image forming unit 30 includes four sets of image forming stations 30Y, 30M, 30C and 30K, and an intermediate transfer belt 15.

Each of the image forming stations 30Y, 30M, 30C and 30K includes a photoconductive drum 31. A charging device 32, a developing unit 34 and a cleaner 35 are arranged around the photoconductive drum 31. The photoconductive drums of the image forming stations 30Y, 30M, 30C and 30K rotate rightward toward the +Y direction as shown by arrows.

The outer peripheral surface of each of the photoconductive drums 31 is charged by the charging device 32. A laser beam emitted from the laser exposure device 13 is irradiated to the surface of each of the photoconductive drums 31. By this, an electrostatic latent image is formed on the surface of the photoconductive drum 31.

The developing unit 34 includes a developer made of a toner of yellow (Y), magenta (M), cyan (C) or black (K) and a carrier. The developing unit 34 supplies the toner to the upper surface of the photoconductive drum 31. By this, a yellow (Y) toner image is visualized on the photoconductive drum 31 of the image forming station 30Y. Similarly, a magenta (M) toner image is visualized on the photoconductive drum 31 of the image forming station 30M, a cyan (C) toner image is visualized on the photoconductive drum 31 of the image forming station 30C, and a black (K) toner image is visualized on the photoconductive drum 31 of the image forming station 30K.

The intermediate transfer belt 15 is stretched around a drive roller 21, a driven roller 22, and tension rollers 24 and 25. The intermediate transfer belt 15 is pressed to the photoconductive drum 31 of each of the image forming stations 30Y, 30M, 30C and 30K by a primary transfer roller 36 of each of the image forming stations 30Y, 30M, 30C and 30K. Besides, a secondary transfer roller 23 is arranged near the drive roller 21.

In the image forming unit 30, when the drive roller 21 is driven and the intermediate transfer belt 15 is rotated in an arrow direction, toner images formed on the respective photoconductive drums 31 of the image forming stations 30Y, 30M, 30C and 30K are sequentially transferred onto the intermediate transfer belt 15. At this time, toner remaining on the surface of the photoconductive drum 31 is cleaned by the cleaner 35.

The paper feed cassette 10 is detachably attached to the housing 4. The paper feed cassette 10 contains a sheet P as a recording medium on which an image is formed.

The sheet P contained in the paper feed cassette 10 is conveyed by a conveying system 40 including a pickup roller 42, a resist roller 44 and a paper discharge roller 43. Specifically, the sheet P is extracted from the paper feed cassette 10 by the pickup roller 42. The sheet P extracted from the paper feed cassette 10 is conveyed to between the intermediate transfer belt 15 and the secondary transfer roller 23 by the resist roller 44. When reaching the paper discharge roller 43 through the fixing device 17, the sheet is discharged by the paper discharge roller 43 to the paper discharge part formed in the housing 4.

Figure 4:
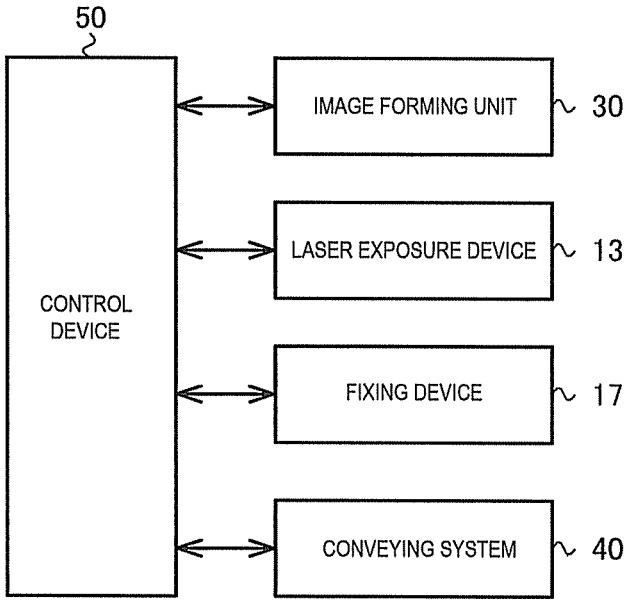
FIG. 4 is a block diagram of a control device.

The control device 50 includes a CPU (Central Processing unit), a main storage part as a working area of the CPU, an auxiliary storage part including a nonvolatile memory such as a magnetic disk or a semiconductor memory, a user interface, and a driving system for driving the image forming unit 30, the laser exposure device 13, the fixing device 17 and the conveying system 40. FIG. 4 is a block diagram showing a control system of the image forming apparatus 1. As shown in FIG. 4, the control device 50 is connected with the image forming unit 30, the laser exposure device 13, the fixing device 17 and the conveying system 40. The control device 50 totally drives the above respective parts.

When printing is performed by the image forming apparatus 1 constructed as described above, the sheet P is extracted from the paper feed cassette 10 by the pickup roller 42, and is conveyed to between the intermediate transfer belt 15 and the secondary transfer roller 23 by the resist roller 44.

In parallel to the above operation, in the image forming apparatus 30, toner images formed on the respective photoconductive drums 31 of the image forming stations 30Y, 30M, 30C and 30K are sequentially transferred onto the intermediate transfer belt 15. By this, a toner image made of yellow (Y) toner, magenta (M) toner, cyan (C) toner and black (K) toner is formed on the intermediate transfer belt 15.

When the sheet P conveyed to between the intermediate transfer belt 15 and the secondary transfer roller 23 passes through the intermediate transfer belt 15 and the secondary transfer roller 23, the toner image formed on the intermediate transfer belt 15 is transferred onto the sheet P. At this time, toner remaining on the surface of the intermediate transfer belt 15 is cleaned by the cleaner 41.

The toner image transferred onto the sheet P is fixed on the sheet P when the sheet P passes through the fixing device 17. By this, an image is formed on the sheet P. The sheet P on which the image is formed is discharged by the paper discharge roller 43 to the paper discharge part formed in the housing 4.

Figure 5:
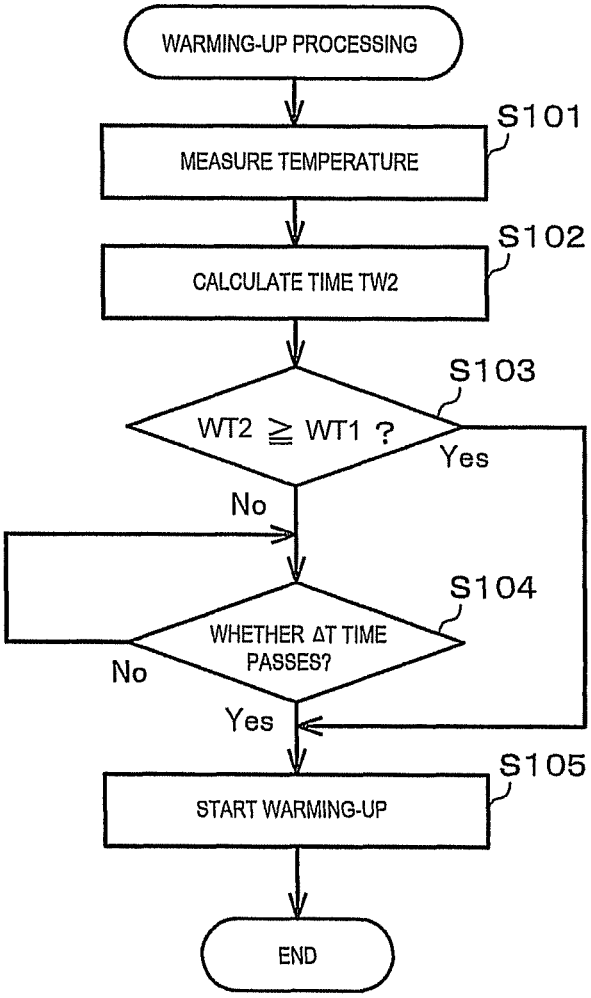
FIG. 5 is a flowchart showing a series of processes which are performed by the control device.

Next, a warming-up operation of the image forming apparatus 1 constructed as described above will be described with reference to a flowchart shown in FIG. 5. When the image forming apparatus 1 is returned from a power saving mode in which the laser exposure device 13, the fixing device 17 and the conveying system 40 are respectively inactive, a specified time is required until the respective parts become operable. When the image forming apparatus 1 is returned from the power saving mode, the control device 50 performs start-up operations of the respective parts of the image forming apparatus 1, and warms up the fixing device 17. When the user releases the power saving mode of the image forming apparatus 1, the control device 50 performs a series of processes shown in FIG. 5.

Figure 6:
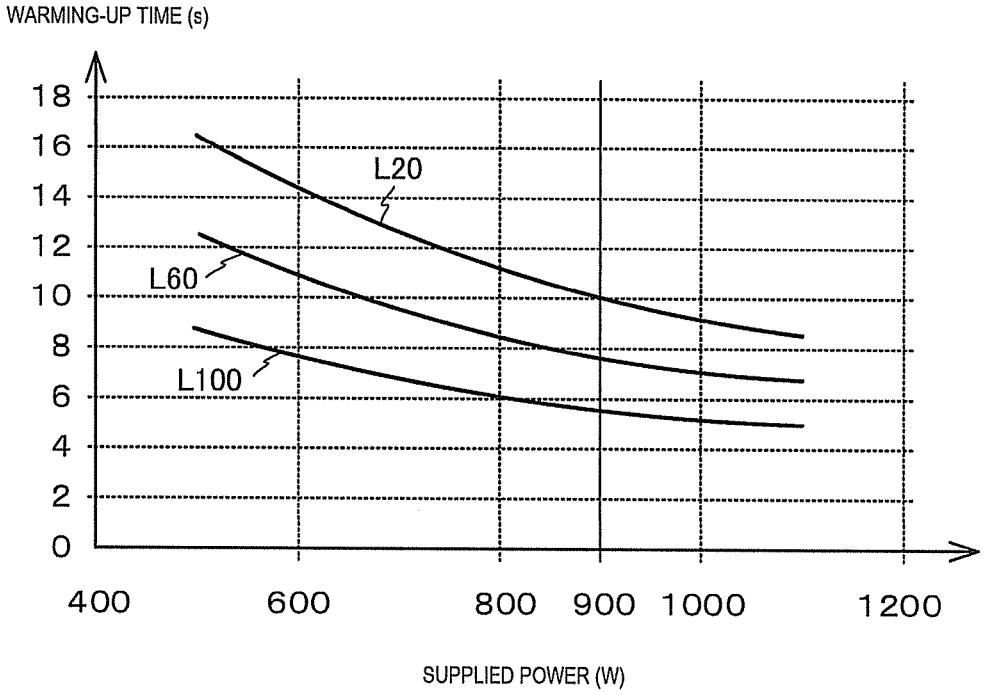
FIG. 6 is a graph showing a relation between power to be supplied to the fixing device and time required for warming-up.

FIG. 6 is a graph showing a relation between power supplied to the fixing device and time required for warming-up. The time required for warming-up is a time required until the fixing belt 300 reaches a target temperature (170° C.) and includes a time required until the heating unit 100 becomes operable. Hereinafter, for convenience of explanation, the time required for warming-up is called a warming-up time.

A line L20 in FIG. 6 indicates a relation between the warming-up time and the supplied power when the fixing belt 300 is 20° C. at the warming-up time start time. A line L60 indicates a relation between the warming-up time and the supplied power when the fixing belt 300 is 60° C. A line L100 indicates a relation between the warming-up time and the supplied power when the fixing belt 300 is 100° C. From the graph, it is understood that for example, when the fixing belt 300 is 20° C., and when a rated power of 900 W is supplied to the fixing device 17 the warming-up of the fixing device 17 is ended in about 10 seconds.

Incidentally, although FIG. 6 shows the lines indicating the relation between the warming-up time and the supplied power when the temperatures of the fixing belt 300 are 20° C., 60° C. and 100° C., there are actually plural lines for respective temperatures of the fixing belt 300. The graph shown in FIG. 6 is previously stored in the control device 50.

Although the warming-up time of the fixing device 17 varies according to the temperature of the fixing belt 300, it is conceivable that the warming-up time of the image forming apparatus 1 including the laser exposure device 13, the fixing device 17 and the conveying system 40, that is, the warming-up time of the image forming apparatus 1 except for the fixing device 17 is substantially a constant time WT1.

Then, the control device 50 obtains the warming-up time when the heating unit 100 is driven at a rated output of 900 W. Specifically, the control device 50 measures the temperature of the fixing belt 300 through the temperature sensor 402 (ACT 101)

Next, the control device 50 obtains a warming-up time WT2 of the fixing device 17 based on the graph shown in FIG. 6 (ACT 102). For example, when the temperature of the fixing belt 300 is 20° C., the warming-up time is about 10 seconds. When the temperature of the fixing belt 300 is 100° C., the warming-up time is about 5.8 seconds.

Next, the control device 50 compares the warming-up time WT2 of the fixing device 17 with the warming-up time WT1 of the image forming apparatus 1 (ACT 103). When determining that the warming-up time WT2 is longer than the warming-up time WT1 (ACT 103: Yes), the control device 50 starts to warm up the fixing device 17 (ACT 105). On the other hand, when determining that the warming-up time WT2 is shorter than the warming-up time WT1 (ACT 103: No), the control device calculates a time Δt by subtracting the warming-up time WT2 from the warming-up time WT1. Then, the control device is on standby until the time Δt passes from the return time from the power saving mode (ACT 104), and starts to warm up the fixing device 17. By this, the warming-up of the fixing device 17 is ended almost simultaneously with the warming-up of the image forming apparatus 1.

As described above, in this embodiment, the warming-up time WT2 of the fixing device 17 is obtained based on the temperature of the fixing belt 300 at the warming-up start time. Besides, the time ΔT is obtained by subtracting the warming-up time WT2 of the fixing device 17 from the warming-up time WT1 of the image forming apparatus 1. If the warming-up time WT2 of the fixing device 17 is shorter than the warming-up time WT1 of the image forming apparatus 1, the time when the warming-up of the fixing device 17 starts is delayed by the time Δt.

Accordingly, the warming-up of the fixing device 17 can be ended almost simultaneously with the warming-up of the image forming apparatus 1. By this, the power consumption required to keep the temperature of the fixing belt 300 of the fixing device 17 until the warming-up of the image forming apparatus 1 is ended can be reduced.

In the embodiment, the description is made about the case where the heating unit 100 heats the fixing belt 300 by the electromagnetic induction. However, no limitation is made to this, and the heating unit 100 may be a lamp or an electric heater whose output is constant.

In the embodiment, the description is made about the case where the rated power (900 W) is supplied to the heating unit 100. However, no limitation is made to this, and if the heating unit 100 can adjust the output, the power supplied to the heating unit 100 may be adjusted according to a situation. For example, if the temperature of the fixing belt 300 is 60° C. and the warming-up time WT1 of the image forming apparatus 1 is 10 seconds, a power of about 700 W lower than the rated power may be supplied to the heating unit 100 for about 10 seconds.

Second Embodiment

Next, an image forming apparatus 1 of a second embodiment will be described. The image forming apparatus 1 of the first embodiment reduces the power consumption by delaying the start time of the warming-up of the fixing device 17. On the other hand, the image forming apparatus 1 of this embodiment is different from the image forming apparatus 1 of the first embodiment in that a control device 50 uses a previously stored table and determines power to be supplied to a heating unit 100.

It is assumed that a temperature of a fixing belt 300 at the warming-up start time of a fixing device 17 is t, and a target temperature of the fixing device 17 is tr. Besides, it is assumed that a time required until the heating unit 100 becomes operable is Ts. In this case, a temperature rise rate S of the fixing belt 300 is proportional to a difference Δt between the target temperature tr of the fixing device 17 and the temperature t of the fixing belt 300 as represented by following expression (1).

$$S=(tr-t)/(TW1-Ts) \quad (1)$$

Then, the power to be supplied to the heating unit 100 is determined based on the temperature difference Δt obtained by subtracting the temperature t from the target temperature tr of the fixing device 17. In this embodiment, for example, as shown in a table TB of FIG. 7, the power to be supplied to the heating unit 100 is previously determined correspondingly to the value of ΔT and is stored in the control device 50. Incidentally, the value of the supplied power in the table TB is regulated by the thermal capacity of the fixing belt 300 and the like and varies according to each image forming apparatus.

Figure 8:
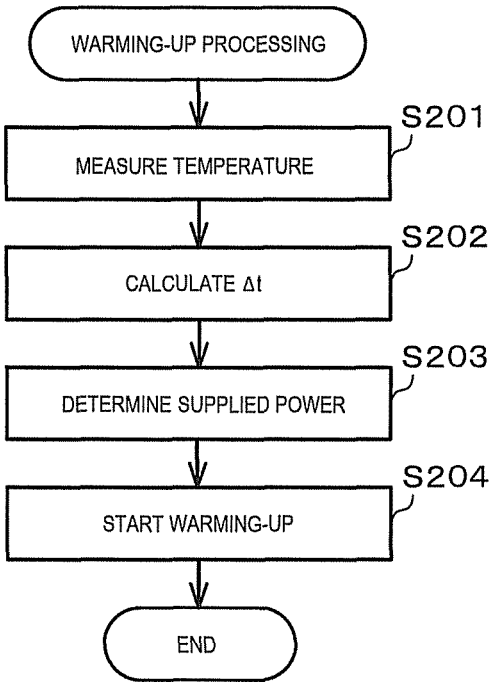
FIG. 8 is a flowchart showing a series of processes performed by the control device.

The control device 50 performs a series of processes shown in a flowchart of FIG. 8. First, the control device 50 measures the temperature t of the fixing belt 300 through a temperature sensor 402 (ACT 201). Next, the temperature difference Δt is calculated by subtracting the temperature t from the target temperature tr of the fixing device 17 (ACT 202). Then, the control device 50 refers to the table TB and determines the power to be supplied to the heating unit 100 (ACT 203). For example, if Δt is 80, the power to be supplied to the heating unit 100 is determined to be 500 W. The control device 50 supplies the power determined by referring to the table TB to the heating unit 100. By this, warming-up of the fixing device 17 is started (ACT 204).

As described above, in this embodiment, the temperature rise rate S is obtained so that the warming-up of the fixing device 17 is ended simultaneously with the warming-up of the image forming apparatus 1. Then, the power required to raise the temperature of the fixing belt 300 at the temperature rise rate S is obtained. Accordingly, when the obtained power is supplied to the heating unit 100, the warming-up of the fixing device 17 can be ended almost simultaneously with the warming-up of the image forming apparatus 1. By this, the power consumption required to keep the temperature of, the fixing belt 300 of the fixing device 17 until the warming-up of the image forming apparatus 1 is ended can be reduced.

Although the embodiments are described, the invention is not limited to the embodiments. For example, in the embodiments, the description is made about the case where the timing when the temperature of the fixing belt 300 reaches the target temperature is made coincident with the timing when the start-up of the image forming apparatus 1 is completed. If the timing difference between the former and the latter is decreased, the power consumption to keep the target temperature can be reduced. Thus, a certain time difference may be provided between the former and the latter within a range in which the effect can be achieved.

In the embodiments, the target temperature of the fixing belt 300 is the fixable temperature at which the toner image formed on the sheet can be fixed on the sheet. However, no limitation is made to this, and the target temperature of the fixing belt 300 may be a temperature which can reach the fixable temperature in a short time.

The temperature sensor 402 in the embodiments may be arranged inside the fixing belt 300 or outside the fixing belt 300. Besides, the temperature sensor 402 may be of a contact type or a non-contact type such as, for example, an infrared sensor.

Although exemplary embodiments have been described, these embodiments have been presented by way of example only, and are not intended to limit the scope of the invention. Indeed, these novel embodiments can be carried out in a variety of other forms, and various omissions, substitutions and changes can be made within the scope not departing from the spirit of the invention. These embodiments and modifications thereof fall within the scope and spirit of the invention and fall within the scope of the invention recited in the claims and their equivalents.

What is claimed is:

1. An image forming apparatus for forming an image on a recording medium, comprising:

a fixing member to fix toner to the recording medium;

a heating control part to heat the fixing member to a specified temperature;

a measuring part to measure a temperature of the fixing member; and a calculation part to calculate an arrival time required until the temperature of the fixing member reaches a target temperature based on a difference between the target temperature at a warming-up end time of the fixing member and the temperature measured by the measuring part, wherein in response to a determination by the calculation part that the arrival time is shorter than a warm-up time required to warm up the image forming apparatus except for the fixing device, the heating control part starts to heat the fixing member after a specified time passes from a time when warming-up of the image forming apparatus is started.

2. The apparatus according to claim 1, wherein the heating control part starts to heat the fixing member at a timing when a first time at which the temperature of the fixing member reaches the target temperature is coincident with a second time at which a warming-up of the image forming apparatus is ended.

3. The apparatus according to claim 1, wherein the calculation part accesses reference data indicating a relation between power to be supplied to the heating control part and time required until the temperature of the fixing member reaches the target temperature, and the calculation part obtains the arrival time based on the temperature measured by the measuring part and the reference data.

4. The apparatus according to claim 3, wherein the calculation part obtains an output power of the heating control part based on the temperature measured by the measuring part and the reference data, and the heating control part heats the fixing member at the output power obtained by the calculation part.

5. An image forming method, comprising:

measuring, by an image forming apparatus comprising at least one central processing unit, a temperature of a fixing member for fixing toner to a recording medium;

calculating, by the image forming apparatus, an arrival time required until the temperature of the fixing member reaches a target temperature based on a difference between the target temperature at a warming-up end time of the fixing member and the measured temperature of the fixing member; and in response to a determination that the arrival time is shorter than a warm up time required for warming-up of an image forming apparatus except for the fixing member, starting, by the image forming apparatus, to heat the fixing member after a specified time passes from a time when warming-up of the image forming apparatus is started.

* * * * *